United States Patent [19]

Yao

[11] 4,124,309

[45] Nov. 7, 1978

[54] DISPERSION METHOD AND APPARATUS

[75] Inventor: Yasunori Yao, Tokyo, Japan

[73] Assignee: Fuji Photo Film Co., Ltd., Minami Ashigara, Japan

[21] Appl. No.: 806,122

[22] Filed: Jun. 13, 1977

[30] Foreign Application Priority Data

Jun. 11, 1976 [JP] Japan ..... 51-69152

[51] Int. Cl.[2] ..... B01F 5/06

[52] U.S. Cl. ..... 366/340

[58] Field of Search ..... 259/4 R, 4 AB, 4 AC, 259/4 A, 18, 36; 138/42; 366/337, 340, 336

[56] References Cited

U.S. PATENT DOCUMENTS

| | | | |
|---|---|---|---|
| 2,890,868 | 6/1959 | Potchen | 259/4 AB |
| 3,526,391 | 9/1970 | Church | 259/4 AB |
| 3,856,270 | 12/1974 | Hemker | 259/4 AB |
| 4,042,217 | 8/1977 | Snider | 259/4 AB |

*Primary Examiner*—Robert W. Jenkins

*Attorney, Agent, or Firm*—Sughrue, Rothwell, Mion, Zinn and Macpeak

[57] ABSTRACT

A method and apparatus for dispersing one liquid of two mutually insoluble liquids into the other liquid or dispersing a pulverized solid powder into a liquid, wherein a mixture of the two liquids to be dispersed or a mixture of liquids containing pulverized solid powder to be dispersed is jetted through a single or a plurality of unit dispersers to a relatively wider gap portion than a nozzle to impinge upon wall surfaces to change the direction of the liquid flow.

3 Claims, 8 Drawing Figures

DISPERSION METHOD AND APPARATUS

BACKGROUND OF THE INVENTION

1. Field of the Invention

This invention relates to a dispersion method and apparatus. More specifically, the present invention relates to a process and device for dispersing one liquid of two mutually insoluble liquids into the other liquid or dispersing a pulverized solid powder into a liquid.

2. Description of the Prior Art

In the past, ball mills, colloidal mills, ultrasonic dispersion devices, homogenizers, and the like have been used to disperse one liquid of two mutually insoluble liquids into the other liquid or dispersing a pulverized solid powder into a liquid.

However, it has been impossible to obtain a satisfactory degree of dispersion and to obtain a super finely emulsified material or a solid dispersed material with minimal agglomerated particles using these devices as noted above. For example, prior art high pressure homogenizers disclosed in L.P. Deackoff, *American Milk Review,* 24 (3), (28), (1962) or J. Hassel, *Milk Dealer,* 8, 36 (1962) have a section as shown in FIG. 1, of the accompanying drawings whereby dispersion is accomplished merely by the shearing force received from the walls of the apparatus when the liquid passes through a small slit-like gap portion thereof, and hence, it has been difficult to obtain a satisfactory degree of dispersion.

SUMMARY OF THE INVENTION

Therefore, an object of the present invention is to provide a dispersion process and device to produce a super highly dispersed material and with a minimum amount of agglomerated particles.

The above-described object of the present invention is achieved by dispersing a mixture of two liquids to be dispersed or a mixture of liquids containing therein a pulverized solid powder to be dispersed by jetting from a nozzle to a relatively wider gap portion than a nozzle to impinge upon wall surfaces, after which the liquid flow direction is changed.

BRIEF DESCRIPTION OF THE DRAWINGS

Embodiments of the present invention are described in detail with reference to the accompanying drawings in which.

DESCRIPTION OF THE PREFERRED EMBODIMENTS

Figure 1:
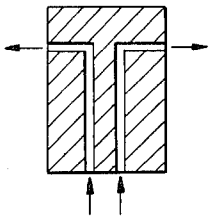
FIG. 1 is a schematic sectional view of a conventional high pressure type homogenizer.
Figure 2:
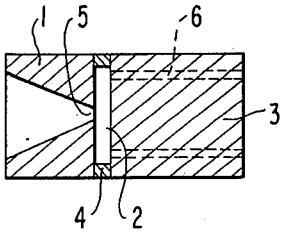
FIGS. 2 and 5 are, respectively, schematic longitudinal sectional views of a dispersion device showing one embodiment in accordance with the present invention.
Figure 3:
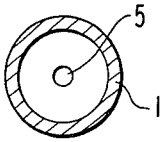
FIGS. 3 and 4 are, respectively, schematic sectional view showing one embodiment of a nozzle and a magazine, respectively, of a unit disperser in accordance with the present invention.
Figure 4:
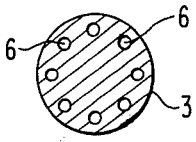

Referring now to FIG. 2, reference numeral 1 designates a nozzle, 2, a gap portion, and 3, a magazine. The dispersion device shown in FIG. 2 has a circular section, and the gap portion 2 is closed at the circumference thereof with a spacer 4. The nozzle 1 has a section as shown in FIG. 3, of which the central portion has an opening to form a blast nozzle 5. The magazine 3 has a section as shown in FIG. 4, having a number of openings 6 in the peripheral portion thereof.

The operation will be described hereinafter by way of an example in which two mutually insoluble liquids are emulsified and dispersed.

An emulsifying agent is preadded to the two liquids to be emulsified and is mixed therein. Then the liquids are pressurized by a pressure pump or the like and then fed to the nozzle 1. The thus supplied pressurized and mixed liquids pass through the nozzle 1 at a very high speed in the form similar to a plug flow, and at this time, a first break-up and dispersion occurs by means of a shearing force exerted on the pressurized mixed liquids. Then, the pressurized mixed liquids passed through the blast nozzle 5 of the nozzle 1 enter the gap portion 2 in the form of a jet and impinge upon walls of the magazine 3 whereby the flow direction of the jet is completely disordered and changed. As a consequence of this, the flow spreads, and subsequently the liquids flow into the openings 6 formed in the periphery of the magazine 3. Then the liquids impinge upon the wall of the magazine 3 and a second break-up and dispersion occurs. As the result of the impringement of the liquids upon the wall of the magazine 3, the direction of flow is rapidly disordered and a third break-up and dispersion occurs. It has been confirmed that the degree of dispersion of the dispersed liquids dispersed as described above is extremely high, and thus a very high dispersion effect is achieved.

Figure 5:
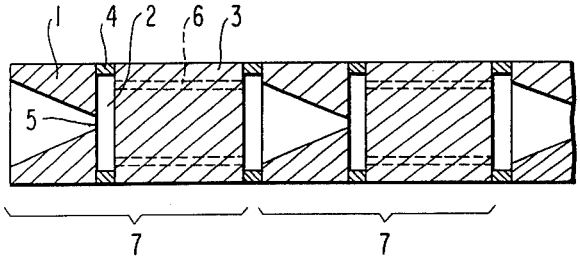

FIG. 5 shows another embodiment of the present invention. In FIG. 5, unit dispersers 7 each comprising the nozzle 1, the gap portion 2 and the magazine 3 as shown in FIG. 2 are connected in series in a multistage fashion through the gap portions 2. In case of employing such a construction as just described, the pressurized mixed liquids jetting into the gap portion 2 from the openings 6 of the magazine 3 in the first unit disperser 7 impinge upon the walls in the peripheral edge of the nozzle 1 and are supplied to the second nozzle 2 while the flow direction thereof is changed, and thereafter, the liquids may be dispersed in a manner similar to the case shown in FIG. 2. In this case, therefore, the degree of dispersion is higher and a marked dispersion effect is obtained. This dispersion effect is more marked than the case in which the liquids are repeatedly passed through a single unit disperser 7 a number of times. Where the liquids are repeatedly passed through a single unit disperser 7 a number of times, a certain time is required from the point wherein the liquids are initially moved out of the unit disperser 7 to the point wherein the liquids are again supplied to the unit disperser 7, and as a result, the dispersed particles initially dispersed and broken-up re-agglomerate and for this reason, a good dispersion effect may not be attained despite the fact that the liquids were passed through the unit disperser 7 a number of times. On the other hand, in the case of the arrangement in which unit dispersers are disposed in a multistage fashion in series, the pressurized mixed liquids passing through the first unit disperser 7 are supplied to the second unit disperser 7 immediately after they have passed through the gap portion 2, and as a result, the broken-up dispersed particles are subjected to a dispersing action in the next stage without agglomeration and for this reason, a marked dispersion effect may be attained. The number of unit dispersers disposed in series is determined depending upon the desired degree of dispersion and the liquids to be dispersed and it is impossible to describe the number generally, and such can be decided experimentally.

It should be noted that the present invention is not limited to those embodiments as described above, and various changes and modification may be made therein.

Figure 6:
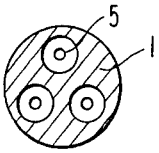
FIGS. 6 and 7 are, respectively, other embodiments thereof.
Figure 7:
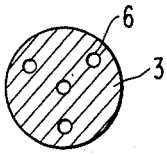

In the above-described embodiments, for example, a nozzle 1 formed with an opening in the central portion thereof and a magazine 3 formed with openings 6 in the peripheral edge thereof is used, but such a nozzle 1 and a magazine 3 as constructed above need not always be used. For example, a design can be used in which a nozzle 1 is formed with three blast nozzles 5 as shown in FIG. 6, and a magazine 3 is formed with openings 6 in a position different from that of the blast nozzles 5 in the nozzle 1 as shown in FIG. 7. Further a design may be used so that the blast nozzles 5 in the nozzle 1 and the openings 6 in the magazine 3 suddenly disorder the flow of the liquids as a result of impingement of the pressurized mixed liquids passed through the nozzle 1 upon the wall surfaces of the magazine 3. The foregoing is a mere illustration.

In order to obtain the effects as noted above, it is necessary for the pressurized mixed liquids to be dispersed to pass through a very small space in an extremely short period of time. These conditions may generally be represented by a pressure loss. In order to obtain the desired degree of dispersion in the present invention, the pressure loss in the unit disperser must be more than about 10 kg/cm$^2$, preferably, more than 50 kg/cm$^2$. Further the space in the gap portion 2 must be big enough to sufficiently disorder the direction of flow of the pressurized mixed liquid passed through the nozzle 1. The actual size of the space will vary with the scale, properties of the liquids used, and so on, and can be determined experimentally.

In dispersion of the liquids by use of an arrangement in which unit dispersers are disposed in a multistage fashion, the dispersed particles or droplets must not reagglomerate until the liquids are dispersed by the second unit disperser after they have been passed through the first unit disperser. That is, the liquids must be supplied to the next unit disperser in a short period of time. To this end, the liquids may be passed through the whole disperser for a period of time from about 1/10,000 to about 1/50 seconds, preferably from 1/10,000 to 1/100 seconds, more preferably, from 1/10,000 to 1/1,000 seconds.

While the description has been given of the case of emulsifying and dispersing two mutually insoluble liquids, it will of course be understood that the present invention may similarly be applied also to the dispersion of a pulverized solid powder into the liquids.

In accordance with the present invention, a dispersed material of sufficiently high degree of dispersion may be obtained. Particularly, in the case where the unit dispersers are connected in a multistage fashion, a super highly divided emulsified dispersed material of a high degree of dispersion or a dispersed material with minimal agglomeration of particles or coalescence of droplets may be obtained. Moreover, the number of unit dispersers connected may be adjusted to obtain the desired degree of dispersion.

For a better understanding of the effects in accordance with the present invention, the following examples are given.

EXAMPLE 1

Liquid I and liquid II as shown in Table 1 were respectively dispersed using a ball mill (pot size: 5 liters), a conventional high pressure type homogenizer (made by Manton Gaulin Ltd. "Model M-3"), and a dispersion device in accordance with the present invention, in which unit dispersers are connected in series in five stages.

Table 1

| | Liquid | Weight Parts |
|---|---|---|
| I | 10 wt% gelatin aqueous solution | 100 |
| | 5 wt% sodium dodecylbenzene sulfonate aqueous solution | 10 |
| II | 1-(2,4,6-trichlorophenyl)-3-{3-[2-(2,4-di-tertiarypentylphenoxy)acetamido-benzamido]}-2-pyrazol-5-one | 12 |
| | Dibutyl Phthalate | 12 |
| | Ethyl Acetate | 25 |

Figure 8:
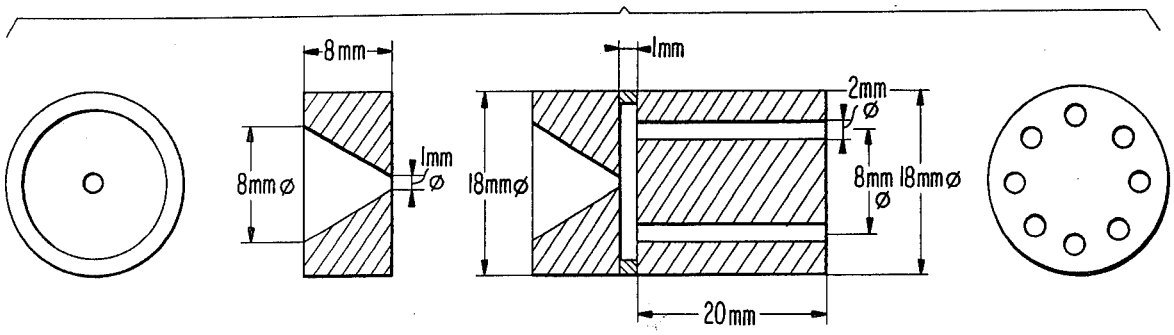
FIG. 8 is a view showing particulars of a unit disperser used in the example.

The dispersing conditions used are respectively given in Table 2. The dispersion condition obtained as a result of such dispersion is shown in the form of an average particle size in association with Table 2. Further, particulars of the dispersion device according to the present invention are shown in FIG. 8.

Table 2

| Device | Dispersion Conditions | Particle Size Result |
|---|---|---|
| Ball Mill | Rotational linear speed: 42 m/min, dispersion time: 40 hr | 1 μ |
| High Pressure-type Homogenizer | Dispersion pressure: 300 kg/cm$^2$ One dispersion | 0.3 μ |
| Dispersion Device of the Present Invention | Dispersion pressure: 300 kg/cm$^2$ Pump discharge amount: 2 l/min | 0.15 μ |

In accordance with the dispersion device of the present invention, the higher degree of emulsification and dispersion of particles were accomplished as compared to other processes.

EXAMPLE 2

15 Weight parts of 12 mμ Aerosil #200 ($SiO_2$ content at least 99.8 wt%) (made by DEGUSSA Ltd., West Germany) were added to Liquid III shown in Table 3 to disperse them by use of the ball mill and the dispersion device according to the present invention. The same dispersion devices and dispersion conditions as those shown in EXAMPLE 1 above were used.

Table 3

| | | Weight Parts |
|---|---|---|
| Liquid III | Chlorinated Polyethylene | 100 |
| | Toluene | 250 |

The viscosity and thixotropic index of the thus dispered solid dispersed material are given in Table 4 below.

Table 4

| Dispersion Device | $\eta 6$(poise) | $\eta 60$(poise) | $\eta 6/\eta 60$ |
|---|---|---|---|
| Ball Mill | 108 | 17.0 | 6.4 |
| Dispersion Device of the | 64.0 | 9.0 | 7.1 |

Table 4-continued

| Dispersion Device | η6(poise) | η60(poise) | η6/η60 |
|---|---|---|---|
| Invention | | | |

where η6, η60 are indicated viscosity values at 6 rpm and 60 rpm, respectively, of a B-type viscometer, and η6/η60 is the thixotropic index.

The results in Table 4 demonstrate that in accordance with the dispersion device of the present invention, dispersed liquids having a much higher degree of dispersion than with a ball mill could be obtained.

While the invention has been described in detail and with reference to specific embodiments thereof, it will be apparent to one skilled in the art that various changes and modifications can be made therein without departing from the spirit and scope thereof.

What is claimed is:

1. In a process for dispersing one liquid of two mutually insoluble liquids into the other liquid or dispersing a pulverized solid powder into a liquid comprising carrying out the following process successively a plurality of times in a continuous series: jetting a mixture of said liquids or said liquid and said solid from a nozzle into a relatively wider gap portion than said nozzle to impinge the mixture upon a wall surface of a magazine containing a plurality of openings thereby changing the liquid flow direction, passing said mixture into said openings and carrying said mixture through said magazine to the feed for the nozzle of the next stage in the series.

2. The process of claim 1, wherein the time of dispersing of the entire process is for a period of time of from about 1/10,000 to about 1/50 second and the pressure loss through a stage of the whole process is more than about 10kg/cm$^2$.

3. A dispersion device for dispersing one liquid of two mutually insoluble liquids into the other liquid or dispersing a pulverized solid powder into a liquid, including a plurality of unit dispersers, each unit disperser which comprises a nozzle having blast nozzles therein for jetting a liquid, means forming a gap portion connected to said nozzle into which said liquid is jetted, and means forming one or more openings in a position different from that of said blast nozzles in said nozzle leading to the nozzle of the next unit.

* * * * *